US010301574B2

(12) United States Patent
Declercq et al.

(10) Patent No.: US 10,301,574 B2
(45) Date of Patent: May 28, 2019

(54) FABRIC ENHANCER COMPOSITION

(71) Applicant: The Procter & Gamble Company, Cincinnati, OH (US)

(72) Inventors: Marc Johan Declercq, Strombeek-Bever (BE); Hans-Jurgen Kohle, Mainhausen (DE); Pieter Jan Maria Saveyn, Heusden (BE)

(73) Assignee: The Procter & Gamble Company, Cincinnati, OH (US)

( * ) Notice: Subject to any disclaimer, the term of this patent is extended or adjusted under 35 U.S.C. 154(b) by 613 days.

(21) Appl. No.: 14/875,940

(22) Filed: Oct. 6, 2015

(65) Prior Publication Data

US 2016/0102273 A1 Apr. 14, 2016

(30) Foreign Application Priority Data

Oct. 8, 2014 (EP) ..... 14188030

(51) Int. Cl.

| | |
|---|---|
| ***C11D 1/62*** | (2006.01) |
| ***C11D 1/645*** | (2006.01) |
| ***C11D 3/00*** | (2006.01) |
| ***C11D 3/30*** | (2006.01) |

(52) U.S. Cl.

CPC ..... *C11D 3/001* (2013.01); *C11D 1/62* (2013.01); *C11D 3/30* (2013.01)

(58) Field of Classification Search

CPC ..... C11D 3/60; C11D 1/61; C11D 1/645

See application file for complete search history.

(56) References Cited

U.S. PATENT DOCUMENTS

| | | | | |
|---|---|---|---|---|
| 4,137,180 | A | 1/1979 | Naik et al. | |
| 5,296,622 | A | 3/1994 | Uphues et al. | |
| 6,001,797 | A | 12/1999 | Ewbank et al. | |
| 6,004,913 | A | 12/1999 | Iacobucci et al. | |
| 6,413,920 | B1 | 7/2002 | Bettiol et al. | |
| 8,188,030 | B2 | 5/2012 | Rieth et al. | |
| 8,569,224 | B2 * | 10/2013 | Kohle | C07C 213/06 510/515 |
| 8,765,659 | B2 | 7/2014 | Gizaw et al. | |
| 8,813,199 | B2 | 8/2014 | Du et al. | |
| 2005/0003980 | A1 | 1/2005 | Baker et al. | |
| 2007/0275866 | A1 | 11/2007 | Dykstra | |
| 2011/0239377 | A1 | 10/2011 | Fossum et al. | |
| 2011/0245138 | A1 * | 10/2011 | Kohle | C07C 213/06 510/515 |
| 2013/0109612 | A1 | 5/2013 | Corona, III et al. | |
| 2016/0102273 | A1 | 4/2016 | Declercq et al. | |

FOREIGN PATENT DOCUMENTS

| | | | |
|---|---|---|---|
| WO | WO9527769 | A1 | 10/1995 |
| WO | WO9527771 | A1 | 10/1995 |

OTHER PUBLICATIONS

ASTM D3954-94 (Reapproved 2010), Standard Test Method for Dropping Point of Waxes.

European Search Report; Application No. EP 14 18 8030.2-1358; dated Jan. 4, 2015; two pages.

* cited by examiner

*Primary Examiner* — Gregory R Delcotto
*Assistant Examiner* — Preeti Kumar
(74) *Attorney, Agent, or Firm* — Gregory S. Darley-Emerson

(57) ABSTRACT

A fabric enhancer composition comprising at least 0.1% by weight of fabric softening active of formula (A):

$$\{[R^2]_2N^+[CH_2—CH(CH_3)—O—C(=O)—R^1][CH(CH_3)—CH_2—O—C(=O)—R^1]\}X^-$$

wherein each $R^2$ is independently either hydrogen, a short chain $C_1$-$C_6$ alkyl, $C_1$-$C_3$ hydroxyalkyl group, a poly ($C_{2-3}$ alkoxy), or benzyl, wherein each $R^1$ is independently a hydrocarbyl group or substituted hydrocarbyl group comprising 11 to 21 carbon atoms, and wherein $X^-$ is any fabric enhancer compatible anion. The composition comprises no more than 50% by weight of diester quaternary ammonium compound.

11 Claims, No Drawings

FABRIC ENHANCER COMPOSITION

FIELD OF THE INVENTION

The present invention relates to fabric enhancer compositions, such as fabric softeners. In particular the invention relates to fabric enhancer composition comprising a fabric softener active providing high softening performance and good storage stability, in particular at high temperature, and having an adequate viscosity.

BACKGROUND OF THE INVENTION

Quaternary ammonium salts carrying two hydrophobic long chain hydrocarbon moieties have found broad use as an active in fabric enhancer compositions. Methyltriethanolammonium methylsulfate fatty acid diesters and dimethyldiethanolammonium chloride fatty acid diesters are well known softening actives. In U.S. Pat. No. 8,813,199 a new class of quaternary ammonium salts is described; the aqueous fabric-enhancer compositions comprising them are particularly stable at high temperature.

However, there is still a need to discover new fabric-softening providing additional benefit, such as good softening performance, good storage stability and good viscosity in a composition.

SUMMARY OF THE INVENTION

The present invention concerns a fabric enhancer composition comprising from 0.1% to 50% by weight of fabric softening active of formula (A):

$$\{[R^2]_2N^+[CH_2—CH(CH_3)—O—C(=O)—R^1][CH(CH_3)—CH_2—O—C(=O)—R^1]\}X^-.$$

Each $R^2$ is independently either hydrogen, a short chain $C_1$-$C_6$ alkyl, $C_1$-$C_3$ hydroxyalkyl group, a poly($C_{2-3}$ alkoxy), or benzyl.

Each $R^1$ is independently a hydrocarbyl group or substituted hydrocarbyl group comprising 11 to 21 carbon atoms.

$X^-$ is any fabric enhancer compatible anion.

The composition comprises no more than 50% by weight of diester quaternary ammonium compound.

The inventors have found that the composition of the invention could exhibit good softening performance, good storage stability and/or good viscosity.

Unless specified otherwise, percentages and ratio are expressed in weight.

DETAILED DESCRIPTION OF THE INVENTION

The Fabric Softening Active of Formula A

The fabric enhancer composition of the invention comprises from 0.1% to 50% by weight of fabric softening active of formula A:

$$\{[R^2]_2N^+[CH_2—CH(CH_3)—O—C(=O)—R^1][CH(CH_3)—CH_2—O—C(=O)—R^1]\}X^-$$

Each $R^2$ is independently either hydrogen, a short chain $C_1$-$C_6$ alkyl, $C_1$-$C_3$ hydroxyalkyl group, a poly($C_{2-3}$ alkoxy), or benzyl. Preferably, each $R^2$ is independently methyl, ethyl, propyl, hydroxyethyl, hydroxyisopropyl, polyethoxy or polypropoxy, preferably each $R^2$ is a methyl.

Each $R^1$ is independantly a hydrocarbyl group or substituted hydrocarbyl group comprising 11 to 21 carbon atoms. Preferably, each $R^1$ is independantly a hydrocarbyl group or substituted hydrocarbyl group a group comprising 13 to 19, preferably 15 to 17, carbon atoms.

$X^-$ is any fabric enhancer compatible anion. Preferably $X^-$ is chloride, bromide, methylsulfate, ethylsulfate, sulphate, or nitrate. Preferably $X^-$ chloride or methylsulfate.

Each $R^1$ may be saturated or unsaturated. The fatty acid corresponding to $R^1$ is a hydrocarbyl group or substituted hydrocarbyl group comprising 12 to 22 carbon atoms. Preferably, the fatty acid corresponding to $R^1$ is independantly a hydrocarbyl group or substituted hydrocarbyl group a group comprising 14 to 20, preferably 16 to 18, carbon atoms. The fatty acid corresponding to $R^1$ may have an iodine value of from 0 to 50, for example from 2 to 50, or from 5 to 40 or from 15 to 35.

Preferably, the composition comprises from 0.2% to 30%, preferably between 0.3% and 15%, preferably between 0.5% and 10%, by weight of fabric softening active of formula A. The composition may comprise less than 5%, or less than 2% by weight of fabric softening active of formula A.

The percentage of fabric softening active of formula A may depend of the desired concentration of softening active in the composition (diluted or concentrated composition) and of the presence or not of other softening active.

The fabric softening active of formula A may be obtained by any known process, for example the process used in example 1. The fabric softeninc active of formula A can be obtained by a process comprising the steps of reacting a mixture, containing (2-hydroxypropyl)-(1-methyl-2-hydroxyethyl)-methylamine and bis-(2-hydroxypropyl)-methylamine at a molar ratio of from 0.05 to 0.20, with a fatty acid having an average chain length of from 12 to 22 carbon atoms, preferably from 16 to 18 carbon atoms, in a molar ratio of fatty acid to amine of from 1.51 to 2.0 with removal of water at a temperature of from 160 to 220° C. until the acid value of the reaction mixture is in the range from 1 to 10 mg KOH/g and further reacting with dimethyl sulphate at a molar ratio of dimethyl sulphate to amine of from 0.90 to 0.97 and preferably from 0.92 to 0.95 until the total amine value of the reaction mixture is in the range from 1 to 8 mg KOH/g.

Additional Fabric Softening Active

The fabric enhancer composition may comprise additional fabric softening active, on top of the fabric softening active of formula A. The fabric enhancer composition may comprise from 0.1% to 50%, preferably from 2% to 30%, preferably from 3% to 25%, by weight of additional fabric softening active. The fabric enhancer composition may comprise from 1 to 50%, preferably from 2% to 30%, preferably from 3% to 25%, by weight of total fabric softening actives. The total fabric softening actives can comprise, preferably consists of: fabric softening active of formula A and the additional fabric softening actives.

Additional fabric softening actives may comprise materials selected from the group consisting of other quaternary ammonium compounds, in particular other diester quaternary ammonium compounds such as fabric softening active of formula B (as defined below), amines, fatty esters, sucrose esters, silicones, dispersible polyolefins, clay, polysaccharides, fatty acids, softening oils, polymer latexes and mixtures thereof.

The fabric enhancer composition may comprise additional quaternary ammonium compounds (quats), in particular other diester quaternary ammonium compounds, such as fabric softening active of formula B.

Quat—Suitable quats include but are not limited to, materials selected from the group consisting of ester quats, amide quats, imidazoline quats, alkyl quats, amdioester quats and mixtures thereof. Suitable ester quats include but are not limited to, materials selected from the group consisting of monoester quats, diester quats, triester quats and mixtures thereof. In one aspect, a suitable ester quat is bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0 to 140, or from 0.5 to 60, from 15 to 50 or from 15 to 25. In one aspect, the cis-trans-ratio of double bonds of unsaturated fatty acid moieties of the bis(2 hydroxypropyl)-dimethylammonium methylsulphate fatty acid ester is from 55:45 to 75:25, respectively. Suitable amide quats include but are not limited to, materials selected from the group consisting of monoamide quats, diamide quats and mixtures thereof. Suitable alkyl quats include but are not limited to, materials selected from the group consisting of mono alkyl quats, dialkyl quats quats, trialkyl quats, tetraalkyl quats and mixtures thereof.

The fabric softening active may be formed from a reaction product of a fatty acid and an aminoalcohol obtaining mixtures of mono-, di-, and, in one embodiment, tri-ester compounds. The fabric softening active may comprise one or more softener quaternary ammonium compounds suchbas a monoalkyquaternary ammonium compound, dialkylquaternary ammonium compound, a diamido quaternary compound, a diester quaternary ammonium compound, or a combination thereof.

The fabric softening active may comprise a diester quaternary ammonium or protonated diester ammonium (hereinafter "DQA") compound composition. The DQA compound compositions also encompass diamido fabric softening actives and fabric softening actives with mixed amido and ester linkages as well as the aforementioned diester linkages, all herein referred to as DQA.

In one aspect, said fabric softening active may comprise, compounds of the following formula:

$$\{R_{4-m}—N^{+}-[X—Y—R^{1}]_{m}\}X^{-} \quad (1)$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, and the like, poly($C^{2-3}$ alkoxy), polyethoxy, benzyl, or mixtures thereof; each X is independently $(CH_2)n$, $CH_2$—$CH(CH_3)$— or CH—$(CH_3)$—$CH_2$—; each Y may comprise —O—(O)C—, —C(O)—O—, —NR—C(O)—, or —C(O)—NR—; each m is 2 or 3; each n is from 1 to about 4, in one aspect 2; the sum of carbons in each $R^1$, plus one when Y is —O—(O)C— or —NR—C(O)—, may be $C_{12}$-$C_{22}$, or $C_{14}$-$C_{20}$, with each $R^1$ being a hydrocarbyl, or substituted hydrocarbyl group; and $X^-$ may comprise any softener-compatible anion. The softener-compatible anion may comprise chloride, bromide, methylsulfate, ethylsulfate, sulfate, and nitrate. The softener-compatible anion may comprise chloride or methyl sulfate.

The fabric softening active may comprise compounds of the general formula:

$$[R_3N^{+}CH_2CH(YR^{1})(CH_2YR^{1})]X^{-}$$

wherein each Y, R, $R^1$, and $X^-$ have the same meanings as before. Such compounds include those having the formula:

$$[CH_3]_3N^{(+)}[CH_2CH(CH_2O(O)CR^{1})O(O)CR^{1}]C1^{(-)} \quad (2)$$

wherein each R may comprise a methyl or ethyl group. In one aspect, each $R^1$ may comprise a $C_{15}$ to $C_{19}$ group. As used herein, when the diester is specified, it can include the monoester that is present.

These types of agents and general methods of making them are disclosed in U.S. Pat. No. 4,137,180. An example of a suitable DEQA (2) is the "propyl" ester quaternary ammonium fabric softener active comprising the formula 1,2-di(acyloxy)-3-trimethylammoniopropane chloride.

The fabric softening active may comprise compounds of the formula:

$$[R_{4-m}—N^{+}—R^{1}_{m}]X- \quad (3)$$

wherein each R, $R^1$, m and $X^-$ have the same meanings as before.

The fabric softening active may comprise compounds of the formula:

(4)

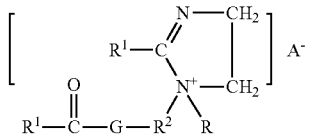

wherein each R, $R^1$, and $A^-$ have the definitions given above; $R^2$ may comprise a $C_{1-6}$ alkylene group, in one aspect an ethylene group; and G may comprise an oxygen atom or an —NR— group;

The fabric softening active may comprise compounds of the formula:

(5)

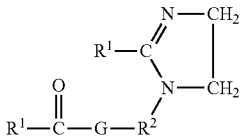

wherein $R^1$, $R^2$ and G are defined as above.

The fabric softening active may comprise condensation reaction products of fatty acids with dialkylenetriamines in, e.g., a molecular ratio of about 2:1, said reaction products containing compounds of the formula:

$$R^{1}—C(O)—NH—R^{2}—NH—R^{3}—NH—C(O)—R^{1} \quad (6)$$

wherein $R^1$, $R^2$ are defined as above, and $R^3$ may comprise a $C_{1-6}$ alkylene group, in one aspect, an ethylene group and wherein the reaction products may optionally be quaternized by the additional of an alkylating agent such as dimethyl sulfate. Such quaternized reaction products are described in additional detail in U.S. Pat. No. 5,296,622.

The fabric softening active may comprise compounds of the formula:

$$[R^{1}—C(O)—NR—R^{2}—N(R)_{2}—R^{3}—NR—C(O)—R^{1}]^{+}A- \quad (7)$$

wherein R, $R^1$, $R^2$, $R^3$ and $A^-$ are defined as above;

The fabric softening active may comprise reaction products of fatty acid with hydroxyalkylalkylenediamines in a molecular ratio of about 2:1, said reaction products containing compounds of the formula:

$$R^{1}—C(O)—NH—R^{2}—N(R^{3}OH)—C(O)—R^{1} \quad (8)$$

wherein $R^1$, $R^2$ and $R^3$ are defined as above;

The fabric softening active may comprise compounds of the formula:

(9)

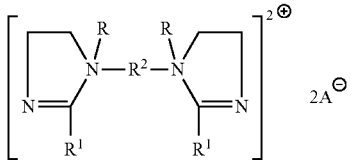

wherein R, $R^1$, $R^2$, and $A^-$ are defined as above.

The fabric softening active may comprise compounds of the formula:

(10)

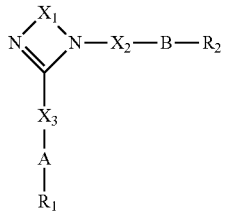

wherein;

$X_1$ is a $C_{2-3}$ alkyl group, in one aspect, an ethyl group;

$X_2$ and $X_3$ are independently $C_{1-6}$ linear or branched alkyl or alkenyl groups, in one aspect, methyl, ethyl or isopropyl groups;

$R_1$ and $R_2$ are independently $C_{8-22}$ linear or branched alkyl or alkenyl groups; characterized in that;

A and B are independently selected from the group comprising —O—(C═O)—, —(C═O)—O—, or mixtures thereof, in one aspect, —O—(C═O)—

Non-limiting examples of fabric softening actives comprising formula (1) are N, N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

Non-limiting examples of fabric softening actives comprising formula (2) is 1, 2 di (stearoyl-oxy) 3 trimethyl ammoniumpropane chloride.

Non-limiting examples of fabric softening actives comprising formula (3) include dialkylenedimethylammonium salts such as dicanoladimethylammonium chloride, di(hard) tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of fabric softening actives comprising formula (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of fabric softening actives comprising formula (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of a fabric softening active comprising formula (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$ is an alkyl group of a commercially available fatty acid derived from a vegetable or animal source, such as Emersol® 223LL or Emersol® 7021, available from Henkel Corporation, and $R^2$ and $R^3$ are divalent ethylene groups.

The fatty acid may be obtained, in whole or in part, from a renewable source, via extraction from plant material, fermentation from plant material, and/or obtained via genetically modified organisms such as algae or yeast.

A non-limiting example of Compound (7) is a di-fatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$ is an alkyl group. An example of such compound is that commercially available from the Witco Corporation e.g. under the trade name Varisoft® 222LT.

An example of a fabric softening active comprising formula (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of a fabric softening active comprising formula (9) is the diquaternary compound having the formula:

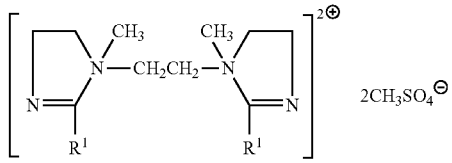

wherein $R^1$ is derived from fatty acid. Such compound is available from Witco Company.

A non-limiting example of a fabric softening active comprising formula (10) is a dialkyl imidazoline diester compound, where the compound is the reaction product of N-(2-hydroxyethyl)-1,2-ethylenediamine or N-(2-hydroxyisopropyl)-1,2-ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid or a mixture of the above.

It will be understood that combinations of softener actives disclosed above are suitable for use in this invention.

Anion A

In the cationic nitrogenous salts herein, the anion $A^-$, which comprises any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, fatty acid anions and the like. The anion A may comprise chloride or methylsulfate. The anion may carry a double charge. In this aspect, $A^-$ represents half a group.

In one embodiment, the fabric softening active may comprise at least one of the following: ditallowoyloxyethyl dimethyl ammonium chloride, dihydrogenated-tallowoyloxyethyl dimethyl ammonium chloride, ditallow dimethyl ammonium chloride, dihydrogenatedtallow dimethyl ammonium chloride, ditallowoyloxyethyl methylhydroxyethylammonium methyl sulfate, dihydrogenated-tallowoyloxyethyl methyl hydroxyethylammonium chloride, or combinations thereof.

Preferably, the fabric enhancer composition comprises from 0.2% to 30%, or between 0.3% and 15%, or between 0.5% and 10%, by weight of quaternary ammonium compound.

The composition comprises no more than 50% by weight of diester quaternary ammonium compound. Preferably, the fabric enhancer composition comprises from 0.2% to 30%, or between 0.3% and 15%, or between 0.5% and 10%, by weight of diester quaternary ammonium compound.

The fabric enhancer composition may comprise fabric softening active of formula B:

$$\{[R^2]_2N^+[CH_2—CH(CH_3)—O—C(=O)—R^1]_2\}X^-$$

Each $R^2$ is independently either hydrogen, a short chain $C_1$-$C_6$ alkyl, $C_1$-$C_3$ hydroxyalkyl group, a poly($C_{2-3}$ alkoxy), benzyl, or mixtures thereof. Preferably, each $R^2$ is independently methyl, ethyl, propyl, hydroxyethyl, hydroxyisopropyl, polyethoxy or polypropoxy, preferably each $R^2$ is a methyl.

Each $R^1$ is independantly a hydrocarbyl group or substituted hydrocarbyl group comprising 11 to 21 carbon atoms. Preferably, each $R^1$ is independantly a hydrocarbyl group or substituted hydrocarbyl group a group comprising 13 to 19, preferably 15 to 17, carbon atoms.

$X^-$ is any fabric enhancer compatible anion. Preferably $X^-$ is chloride, bromide, methylsulfate, ethylsulfate, sulphate, or nitrate. Preferably $X^-$ chloride or methylsulfate.

Preferably, the fabric enhancer composition comprises from 0.2% to 30%, preferably between 0.3% and 15%, preferably between 0.5% and 10%, by weight of fabric softening active of formula B. The fabric enhancer composition may comprise less than 5% or less than 2% by weight of fabric softening active of formula B.

The fabric enhancer composition may comprise a fabric softener active comprising amine.

Suitable amines include but are not limited to, materials selected from the group consisting of amidoesteramines, amidoamines, imidazoline amines, alkyl amines, amdioester amines and mixtures thereof. Suitable ester amines include but are not limited to, materials selected from the group consisting of monoester amines, diester amines, triester amines and mixtures thereof. Suitable amido quats include but are not limited to, materials selected from the group consisting of monoamido amines, diamido amines and mixtures thereof. Suitable alkyl amines include but are not limited to, materials selected from the group consisting of mono alkylamines, dialkyl amines quats, trialkyl amines, and mixtures thereof.

The fabric enhancer composition may comprise a fabric softener active comprising polysaccharide.

The polysaccharide may comprise cationic starch, the fabric enhancer compositions may comprise cationic starch at a level of from about 0.1% to about 7%, alternatively from about 0.1% to about 5%, alternatively from about 0.3% to about 3%, and alternatively from about 0.5% to about 2.0%, by weight of the composition. Suitable cationic starches for use in the present compositions are commercially-available from Cerestar under the trade name C*BOND® and from National Starch and Chemical Company under the trade name CATO® 2A.

The fabric enhancer composition may comprise fabric softener active comprising sucrose esters.

sucrose esters are typically derived from sucrose and fatty acids. Sucrose ester is composed of a sucrose moiety having one or more of its hydroxyl groups esterified.

Sucrose is a disaccharide having the following formula:

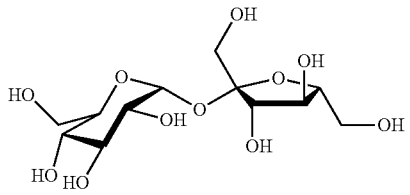

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8−x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are $C_{18}$, alternatively greater than about 50% of the linear chains are $C_{18}$, alternatively greater than about 80% of the linear chains are $C_{18}$.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation. In the case where a higher IV is preferred, such as from about 40 to about 95, then oleic acid and fatty acids derived from soybean oil and canola oil are the starting materials.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

The fabric enhancer composition may comprise fabric softener active comprising dispersible polyolefins.

Polyolefins can be in the format of waxes, emulsions, dispersions or suspensions. Non-limiting examples are discussed below.

The polyolefin is chosen from a polyethylene, polypropylene, or a combination thereof. The polyolefin may be at least partially modified to contain various functional groups, such as carboxyl, alkylamide, sulfonic acid or amide groups. The polyolefin is at least partially carboxyl modified or, in other words, oxidized.

For ease of formulation, the dispersible polyolefin may be introduced as a suspension or an emulsion of polyolefin dispersed by use of an emulsifying agent. The polyolefin suspension or emulsion may comprise from about 1% to about 60%, alternatively from about 10% to about 55%, alternatively from about 20% to about 50% by weight of polyolefin. The polyolefin may have a wax dropping point (see ASTM D3954-94, volume 15.04—"Standard Test Method for Dropping Point of Waxes") from about 20° to about 170° C., alternatively from about 50° to about 140° C. Suitable polyethylene waxes are available commercially from suppliers including but not limited to Honeywell (A-C polyethylene), Clariant (Velustrol® emulsion), and BASF (LUWAX®).

When an emulsion is employed with the dispersible polyolefin, the emulsifier may be any suitable emulsification agent. Non-limiting examples include an anionic, cationic, nonionic surfactant, or a combination thereof. However, almost any suitable surfactant or suspending agent may be employed as the emulsification agent. The dispersible polyolefin is dispersed by use of an emulsification agent in a ratio to polyolefin wax of about 1:100 to about 1:2, alternatively from about 1:50 to about 1:5, respectively.

The fabric enhancer composition may comprise fabric softener active comprising polymer latexes.

Polymer latex are typically made by an emulsion polymerization which includes one or more monomers, one or more emulsifiers, an initiator, and other components familiar to those of ordinary skill in the art. Generally, all polymer latexes that provide fabric care benefits can be used as water insoluble fabric care benefit agents of the present invention. Additional non-limiting examples include the monomers used in producing polymer latexes such as: (1) 100% or pure butylacrylate; (2) butylacrylate and butadiene mixtures with at least 20% (weight monomer ratio) of butylacrylate; (3) butylacrylate and less than 20% (weight monomer ratio) of other monomers excluding butadiene; (4) alkylacrylate with an alkyl carbon chain at or greater than $C_6$; (5) alkylacrylate with an alkyl carbon chain at or greater than $C_6$ and less than 50% (weight monomer ratio) of other monomers; (6) a third monomer (less than 20% weight monomer ratio) added into an aforementioned monomer systems; and (7) combinations thereof.

Polymer latexes that are suitable fabric care benefit agents in the present invention may include those having a glass transition temperature of from about −120° C. to about 120° C., alternatively from about −80° C. to about 60° C. Suitable emulsifiers include anionic, cationic, nonionic and amphoteric surfactants. Suitable initiators include initiators that are suitable for emulsion polymerization of polymer latexes. The particle size diameter ($\chi_{50}$) of the polymer latexes can be from about 1 nm to about 10 μm, alternatively from about 10 nm to about 1 μm, or even from about 10 nm to about 20 nm.

The fabric enhancer composition may comprise fabric softener active comprising fatty acid, such as a free fatty acid (comprising $C_{16}$ to $C_{22}$ saturated and unsaturated, for example behenic acid). The term "fatty acid" is used herein in the broadest sense to include unprotonated or protonated forms of a fatty acid; and includes fatty acid that is bound or unbound to another chemical moiety as well as the various combinations of these species of fatty acid. In one embodiment, the fabric enhancer composition comprises from 0.1% to 5%, preferably from 0.2% to 4%, more preferably from 0.3% to 3% by weight of additional fabric softener active comprising fatty acid. One skilled in the art will readily appreciate that the pH of an aqueous composition will dictate, in part, whether a fatty acid is protonated or unprotonated. In another embodiment, the fatty acid is in its unprotonated, or salt form, together with a counter ion, such as, but not limited to, calcium, magnesium, sodium, potassium and the like. The term "free fatty acid" means a fatty acid that is not bound to another chemical moiety (covalently or otherwise) to another chemical moiety.

The fatty acid may include those containing from about 12 to about 25, from about 13 to about 22, or even from about 16 to about 20, total carbon atoms, with the fatty moiety containing from about 10 to about 22, from about 12 to about 18, or even from about 14 (mid-cut) to about 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc.; (3) processed and/or bodied oils, such as linseed oil or tung oil via thermal, pressure, alkali-isomerization and catalytic treatments; (4) a mixture thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids.

Mixtures of fatty acids from different fat sources can be used.

At least a majority of the fatty acid that is present in the fabric softening composition of the present invention may be unsaturated, e.g., from about 40% to 100%, from about 55% to about 99%, or even from about 60% to about 98%, by weight of the total weight of the fatty acid present in the composition, although fully saturated and partially saturated fatty acids can be used. As such, the total level of polyunsaturated fatty acids (TPU) of the total fatty acid of the inventive composition may be from about 0% to about 75% by weight of the total weight of the fatty acid present in the composition.

The cis/trans ratio for the unsaturated fatty acids may be important, with the cis/trans ratio (of the C18:1 material) being from at least about 1:1, at least about 3:1, from about 4:1 or even from about 9:1 or higher.

Branched fatty acids such as isostearic acid are also suitable since they may be more stable with respect to oxidation and the resulting degradation of color and odor quality.

The Iodine Value or "IV" measures the degree of unsaturation in the fatty acid. The fatty acid may have an IV from about 10 to about 140, from about 15 to about 100 or even from about 15 to about 60.

The fabric enhancer composition may comprise fabric softener active comprising softening oil.

softening oils, includes but are not limited to, vegetable oils (such as soybean, sunflower, coconut-oil and canola), hydrocarbon based oils (natural and synthetic petroleum lubricants, in one aspect polyolefins, isoparaffins, and cyclic paraffins), triolein, caprylic/capric acid triglyceride, fatty esters (such as glycerol monostearate and glycerol distearate), fatty alcohols (such as palmityl and stearyl alcohol), fatty amines, fatty amides, and fatty ester amines. Oils can be combined with fatty acid softening agents, clays, and silicones. In one embodiment, the fabric enhancer composition comprises from 0.1% to 5%, preferably from 0.2% to 4%, more preferably from 0.3 to 3% by weight of additional fabric softener active comprising softening oils.

The fabric enhancer composition may comprise fabric softener active comprising clay.

The fabric care composition may comprise a clay as a fabric care active. In one embodiment clay can be a softener or co-softeners with another softening active, for example, silicone. Suitable clays include those materials classified geologically smectites.

The fabric enhancer composition may comprise fabric softener active comprising silicone.

Suitable levels of silicone may comprise from about 0.1% to about 70%, alternatively from about 0.3% to about 40%, alternatively from about 0.5% to about 30%, alternatively from about 1% to about 20% by weight of the composition. Useful silicones can be any silicone comprising compound. The silicone polymer may be selected from the group consisting of cyclic silicones, polydimethylsiloxanes, aminosilicones, cationic silicones, silicone polyethers, silicone resins, silicone urethanes, and mixtures thereof. In one embodiment, the silicone is a polydialkylsilicone, alternatively a polydimethyl silicone (polydimethyl siloxane or "PDMS"), or a derivative thereof. In another embodiment, the silicone is chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

In another embodiment, the silicone may be chosen from a random or blocky organosilicone polymer having the following formula:

$$[R_1R_2R_3SiO_{1/2}]_{j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_6$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubsitituted divalent alkylene radical comprising 2-12 carbon atoms, in one aspect each divalent alkylene radical is independently selected from the group consisting of —$(CH_2)_s$— wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

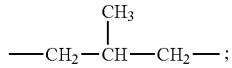

each Z is selected independently from the group consisting of

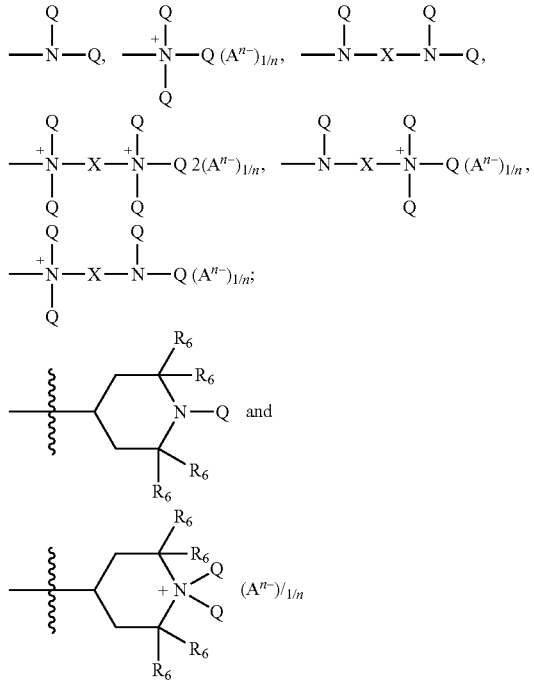

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

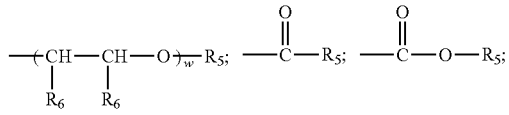

-continued

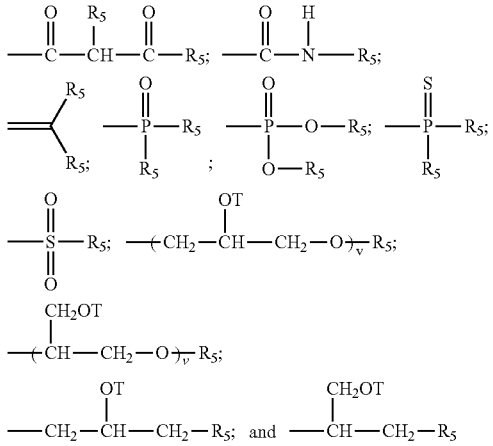

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

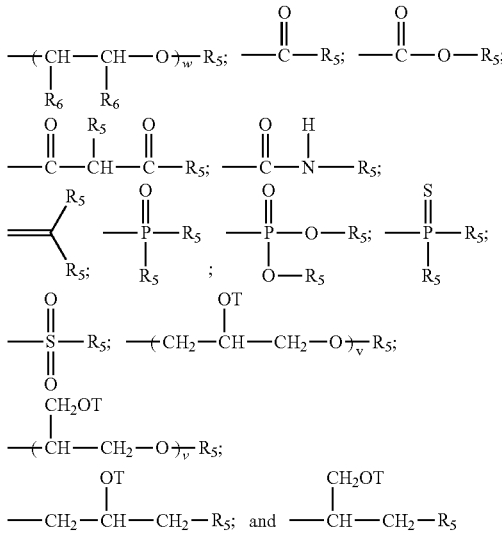

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6—CHR_6—O—)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

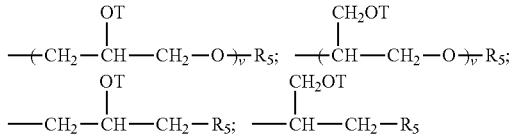

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$=—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—; —$CH_2$—CH(OH)—$CH_2$—O—;

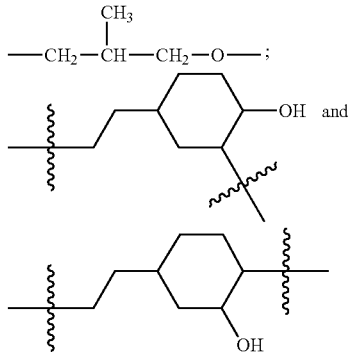

wherein each s independently is an integer from about 2 to about 8, in one aspect s is an integer from about 2 to about 4;

At least one Z in the said organosiloxane is selected from the group consisting of $R_5$;

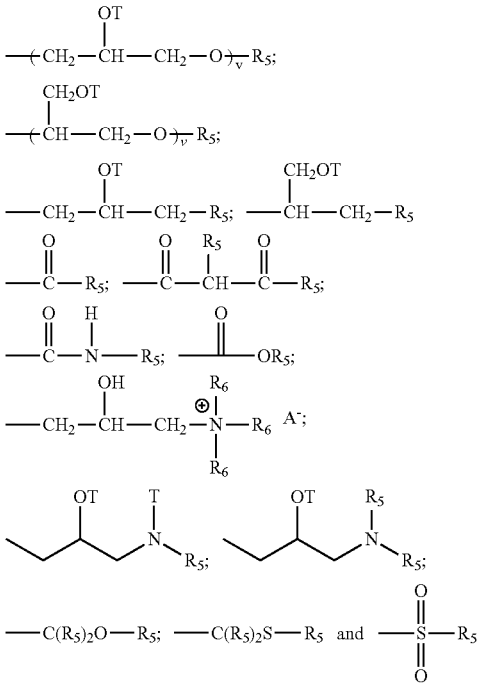

provided that when X is

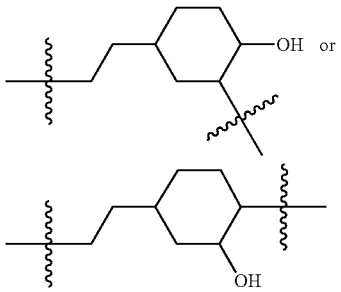

then Z═—$OR_5$ or

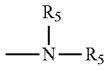

wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

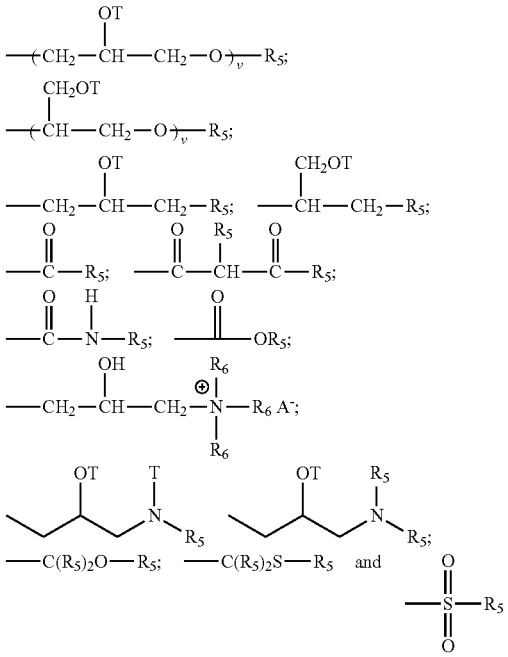

provided that when X is

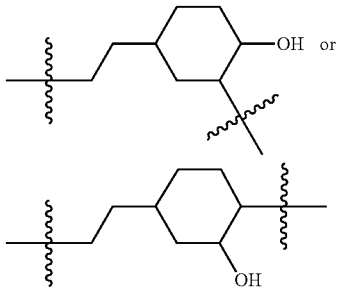

then Z═—$OR_5$ or

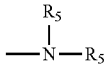

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, —$(CHR_6—CHR_6—O—)_w$—$CHR_6$—$CHR_6$-L and siloxyl residue wherein each L is independently selected from —O—C(O)—$R_7$ or —O—$R_7$;

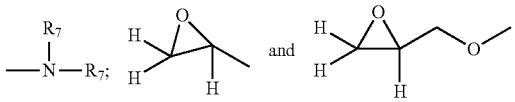

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue;

each T is independently selected from H;

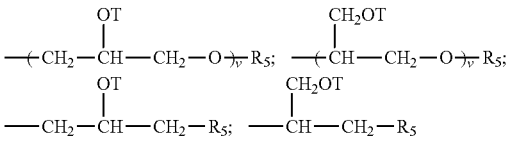

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

In one embodiment, the silicone is one comprising a relatively high molecular weight. A suitable way to describe the molecular weight of a silicone includes describing its viscosity. A high molecular weight silicone is one having a viscosity of from about 10 cSt to about 3,000,000 cSt, or from about 100 cSt to about 1,000,000 cSt, or from about 1,000 cSt to about 600,000 cSt, or even from about 6,000 cSt to about 300,000 cSt.

In one embodiment, the silicone comprises a blocky cationic organopolysiloxane having the formula:

$$M_wD_xT_yQ_z$$

wherein:

M=[$SiR_1R_2R_3O_{1/2}$], [$SiR_1R_2G_1O_{1/2}$], [$SiR_1G_1G_2O_{1/2}$], [$SiG_1G_2G_3O_{1/2}$], or combinations thereof;

D=[$SiR_1R_2O_{2/2}$], [$SiR_1G_1O_{2/2}$], [$SiG_1G_2O_{2/2}$] or combinations thereof;

T=[$SiR_1O_{3/2}$], [$SiG_1O_{3/2}$] or combinations thereof;

Q=[$SiO_{4/2}$];

w=is an integer from 1 to (2+y+2z);

x=is an integer from 5 to 15,000;

y=is an integer from 0 to 98;

z=is an integer from 0 to 98;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy, $C_1$-$C_{32}$ alkylamino, and $C_1$-$C_{32}$ substituted alkylamino;

at least one of M, D, or T incorporates at least one moiety $G_1$, $G_2$ or $G_3$; and $G_1$, $G_2$, and $G_3$ are each independently selected from the formula:

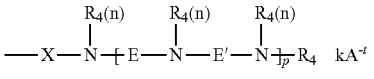

wherein:

X comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide, and ring-opened glycidyl, with the proviso that if X does not comprise a repeating alkylene oxide moiety then X can further comprise a heteroatom selected from the group consisting of P, N and O;

each $R_4$ comprises identical or different monovalent radicals selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

E comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E does not comprise a repeating alkylene oxide moiety then E can further comprise a heteroatom selected from the group consisting of P, N, and O;

E' comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E' does not comprise a repeating alkylene oxide moiety then E' can further comprise a heteroatom selected from the group consisting of P, N, and O;

p is an integer independently selected from 1 to 50;

n is an integer independently selected from 1 or 2;

when at least one of $G_1$, $G_2$, or $G_3$ is positively charged, $A^{-t}$ is a suitable charge balancing anion or anions such that the total charge, k, of the charge-balancing anion or anions is equal to and opposite from the net charge on the moiety $G_1$, $G_2$ or $G_3$; wherein t is an integer independently selected from 1, 2, or 3; and $k \leq (p*2/t)+1$; such that the total number of cationic charges balances the total number of anionic charges in the organopolysiloxane molecule;

and wherein at least one E does not comprise an ethylene moiety.

Preferably, the ratio of [fabric softening active of formula A] to [total amount of fabric softening active] is from 0.01 to 0.99, preferably from 0.02 to 0.50, preferably from 0.05 to 0.20.

Preferably, the ratio of [fabric softening active of formula A] to [total amount of fabric softening active selected from quaternary ammonium compounds, amines, fatty esters, sucrose esters, silicones, dispersible polyolefins, clay, polysaccharides, fatty acids, softening oils, polymer latexes and mixtures thereof] is from 0.01 to 0.99, preferably from 0.02 to 0.50, preferably from 0.05 to 0.20.

Preferably, the ratio of [fabric softening active of formula A] to [total amount of fabric softening active selected from quaternary ammonium compounds] is from 0.01 to 0.99, preferably from 0.02 to 0.50, preferably from 0.05 to 0.20.

Preferably, the ratio of [fabric softening active of formula A] to [total amount of fabric softening active selected from diester quaternary ammonium compounds] is from 0.01 to 0.99, preferably from 0.02 to 0.50, preferably from 0.05 to 0.20.

Preferably, the ratio of [fabric softening active of formula A] to [total amount of fabric softening active of formula A and of formula B] is from 0.01 to 0.99, preferably from 0.02 to 0.50, preferably from 0.05 to 0.20.

The Fabric Enhancer Composition

The fabric enhancer composition preferably is in liquid form. The fabric enhancer composition preferably has a pH at 20° C. comprised between 1 and 6, preferably between 2 and 5 or between 2.5 and 4.5. The fabric enhancer may have a Brookfield® DV-E viscosity in cP, at 60 rpm, at 20° C. above 5 or above 10 or above 20 or above 40 or above 80 or above 160 or above 320 and/or below 20,000 or below 10,000.

The fabric enhancer composition is preferably aqueous and preferably comprises at least 50% by weight of water, preferably at least 75%, for examples more than 85% by weight of water.

The fabric enhancer composition may comprise adjunct ingredients suitable for use in the instant compositions and may be desirably incorporated in certain aspects of the invention, for example to assist or enhance cleaning performance, for treatment of the substrate to be cleaned, or to modify the aesthetics of the composition as is the case with perfumes, colorants, dyes or the like. The precise nature of these additional components, and levels of incorporation thereof, will depend on the physical form of the composition and the nature of the fabric treatment operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, hueing dyes, perfumes, perfume delivery systems, structure elasticizing agents, carriers, structurants, hydrotropes, processing aids, solvents and/or pigments.

As stated, the adjunct ingredients are not essential to Applicants' compositions. Thus, certain aspects of Applicants' compositions do not contain one or more of the following adjuncts materials: surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, hueing dyes, perfumes, perfume delivery systems structure elasticizing agents, carriers, hydrotropes, processing aids, solvents and/or pigments. However, when one or more adjuncts are present, such one or more adjuncts may be present as detailed below.

Hueing Dye—The composition may comprise a hueing dye. The hueing dyes employed in the present laundry care compositions may comprise polymeric or non-polymeric dyes, organic or inorganic pigments, or mixtures thereof. Preferably the hueing dye comprises a polymeric dye, comprising a chromophore constituent and a polymeric constituent. The chromophore constituent is characterized in that it absorbs light in the wavelength range of blue, red, violet, purple, or combinations thereof upon exposure to light. In one aspect, the chromophore constituent exhibits an absorbance spectrum maximum from about 520 nanometers to about 640 nanometers in water and/or methanol, and in another aspect, from about 560 nanometers to about 610 nanometers in water and/or methanol.

Although any suitable chromophore may be used, the dye chromophore is preferably selected from benzodifuranes, methine, triphenylmethanes, napthalimides, pyrazole, napthoquinone, anthraquinone, azo, oxazine, azine, xanthene, triphenodioxazine and phthalocyanine dye chromophores. Mono and di-azo dye chromophores are may be preferred.

The hueing dye may comprise a dye polymer comprising a chromophore covalently bound to one or more of at least three consecutive repeat units. It should be understood that the repeat units themselves do not need to comprise a chromophore. The dye polymer may comprise at least 5, or at least 10, or even at least 20 consecutive repeat units.

The repeat unit can be derived from an organic ester such as phenyl dicarboxylate in combination with an oxyalkyleneoxy and a polyoxyalkyleneoxy. Repeat units can be derived from alkenes, epoxides, aziridine, carbohydrate including the units that comprise modified celluloses such as hydroxyalkylcellulose; hydroxypropyl cellulose; hydroxypropyl methylcellulose; hydroxybutyl cellulose; and, hydroxybutyl methylcellulose or mixtures thereof. The repeat units may be derived from alkenes, or epoxides or mixtures thereof. The repeat units may be $C_2$-$C_4$ alkyleneoxy groups, sometimes called alkoxy groups, preferably derived from $C_2$-$C_4$ alkylene oxide. The repeat units may be $C_2$-$C_4$ alkoxy groups, preferably ethoxy groups.

For the purposes of the present invention, the at least three consecutive repeat units form a polymeric constituent. The polymeric constituent may be covalently bound to the chromophore group, directly or indirectly via a linking group. Examples of suitable polymeric constituents include polyoxyalkylene chains having multiple repeating units. In one aspect, the polymeric constituents include polyoxyalkylene chains having from 2 to about 30 repeating units, from 2 to about 20 repeating units, from 2 to about 10 repeating units or even from about 3 or 4 to about 6 repeating units. Non-limiting examples of polyoxyalkylene chains include ethylene oxide, propylene oxide, glycidol oxide, butylene oxide and mixtures thereof.

Surfactants—The composition may comprise a surfactant or surfactant system wherein the surfactant can be selected from nonionic surfactants, anionic surfactants, cationic surfactants, ampholytic surfactants, zwitterionic surfactants, semi-polar nonionic surfactants and mixtures thereof.

The surfactant is typically present at a level of from about 0.1% to about 60%, from about 1% to about 50% or even from about 5% to about 40% by weight of the subject composition.

Chelating Agents—The composition may contain a chelating agent. Suitable chelating agents include copper, iron and/or manganese chelating agents and mixtures thereof. When a chelating agent is used, the composition may comprise from about 0.1% to about 15% or even from about 3.0% to about 10% chelating agent by weight of the subject composition.

Dye Transfer Inhibiting Agents—The composition may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

When present in a subject composition, the dye transfer inhibiting agents may be present at levels from about 0.0001% to about 10%, from about 0.01% to about 5% or even from about 0.1% to about 3% by weight of the composition.

Dispersants—The composition can also contain dispersants. Suitable water-soluble organic materials include the homo- or co-polymeric acids or their salts, in which the polycarboxylic acid comprises at least two carboxyl radicals separated from each other by not more than two carbon atoms.

Perfumes—The composition may comprise a perfume that may include materials selected from the group consisting of perfumes such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal, α-damascone, β-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl)propyl]cyclopentan-2-one, 2-sec-butylcyclohexanone, and β-dihydro ionone, linalool, ethyllinalool, tetrahydrolinalool, and dihydromyrcenol.

Perfume Delivery Technologies—The fabric enhancer compositions may comprise one or more perfume delivery technologies that stabilize and enhance the deposition and release of perfume ingredients from treated substrate. Such perfume delivery technologies can also be used to increase the longevity of perfume release from the treated substrate. Perfume delivery technologies, methods of making certain perfume delivery technologies and the uses of such perfume delivery technologies are disclosed in US 2007/0275866 A1.

In one aspect, the fabric enhancer composition may comprise from about 0.001% to about 20%, or from about 0.01% to about 10%, or from about 0.05% to about 5%, or even from about 0.1% to about 0.5% by weight of the perfume delivery technology. In one aspect, said perfume delivery technologies may be selected from the group consisting of: perfume microcapsules, pro-perfumes, polymer particles, functionalized silicones, polymer assisted delivery, molecule assisted delivery, fiber assisted delivery, amine assisted delivery, cyclodextrins, starch encapsulated accord, zeolite and inorganic carrier, and mixtures thereof:

In one aspect, said perfume delivery technology may comprise microcapsules formed by at least partially surrounding a benefit agent with a wall material. Said benefit agent may include materials selected from the group consisting of perfumes such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal, α-damascone, 62-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl)propyl]cyclopentan-2-one, 2-sec-butylcyclohexanone, and β-dihydro ionone, linalool, ethyllinalool, tetrahydrolinalool, and dihydromyrcenol; silicone oils, waxes such as polyethylene waxes; essential oils such as fish oils, jasmine, camphor, lavender; skin coolants such as menthol, methyl lactate; vitamins such as Vitamin A and E; sunscreens; glycerine; catalysts such as manganese catalysts or bleach catalysts; bleach particles such as perborates; silicon dioxide particles; antiperspirant actives; cationic polymers and mixtures thereof. Suitable benefit agents can be obtained from Givaudan Corp. of Mount Olive, N.J., USA, International Flavors & Fragrances Corp. of South Brunswick, N.J., USA, or Quest Corp. of Naarden, Netherlands. In one aspect, the microcapsule wall material may comprise: melamine, polyacrylamide, silicones, silica, polystyrene, polyurea, polyurethanes, polyacrylate based materials, gelatin, styrene malic anhydride, polyamides, and mixtures thereof. In one aspect, said melamine wall material may comprise melamine crosslinked with formaldehyde, melamine-dimethoxyethanol crosslinked with formaldehyde, and mixtures thereof. In one aspect, said polystyrene wall material may comprise polyestyrene cross-linked with divinylbenzene. In one aspect, said polyurea wall material may comprise urea crosslinked with formaldehyde, urea crosslinked with gluteraldehyde, and mixtures thereof. In one aspect, said polyacrylate based materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof. In one aspect, the perfume microcapsule may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, and combinations thereof. Suitable deposition aids are described above and in the section titled "Deposition Aid". In one aspect, the microcapsule may be a perfume microcapsule. In one aspect, one or more types of microcapsules, for example two microcapsules types having different perfume benefit agents may be used.

In one aspect, said perfume delivery technology may comprise an amine reaction product (ARP) or a thio reaction product. One may also use "reactive" polymeric amines and or polymeric thios in which the amine and/or thio functionality is pre-reacted with one or more PRMs to form a reaction product. Typically the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxyl amines, such as 2-aminoethanol and its alkyl substituted derivatives, and aromatic amines such as anthranilates. The ARPs may be premixed with perfume or added separately in leave-on or rinse-off applications. In another aspect, a material that contains a heteroatom other than nitrogen and/or sulfur, for example oxygen, phosphorus or selenium, may be used as an alternative to amine compounds. In yet another aspect, the aforementioned alternative compounds can be used in combination with amine compounds. In yet another aspect, a single molecule may comprise an amine moiety and one or more of the alternative heteroatom moieties, for example, thiols, phosphines and selenols. The benefit may include improved delivery of perfume as well as controlled perfume release. Suitable ARPs as well as methods of making same can be found in USPA 2005/0003980 A1 and U.S. Pat. No. 6,413,920 B1.

Processes of Making the Fabric Enhancer of the Invention

The compositions of the present invention can be formulated into any suitable form and prepared by any process chosen by the formulator, non-limiting examples of which are described in Applicant's examples and in US 2013/0109612 A1 which is incorporated herein by reference.

In one aspect, the compositions disclosed herein may be prepared by combining the components thereof in any convenient order and by mixing, e.g., agitating, the resulting component combination to form a phase stable fabric and/or home care composition. In one aspect, a fluid matrix may be formed containing at least a major proportion, or even substantially all, of the fluid components with the fluid components being thoroughly admixed by imparting shear agitation to this liquid combination. For example, rapid stirring with a mechanical stirrer may be employed.

Method of Use

The compositions of the present invention may be used in any conventional manner. In short, they may be used in the same manner as products that are designed and produced by conventional methods and processes. For example, compositions of the present invention can be used to treat a situs inter alia a surface or fabric. Typically at least a portion of the situs is contacted with an aspect of Applicants' composition, in neat form or diluted in a wash liquor, and then the situs is optionally washed and/or rinsed. For purposes of the present invention, washing includes but is not limited to, scrubbing, and mechanical agitation. The fabric may comprise any fabric capable of being laundered in normal consumer use conditions. When the wash solvent is water, the water temperature typically ranges from about 5° C. to about 90° C. and, when the situs comprises a fabric, the water to fabric mass ratio is typically from about 1:1 to about 100:1.

The consumer products of the present invention may be used as liquid fabric enhancers wherein they are applied to a fabric and the fabric is then dried via line drying and/or drying the an automatic dryer.

EXAMPLES

Example 1: Preparation of a Fabric Softener Actives Mixture 1372 g (4.98 mol) of a partially hydrogenated vegetable fatty acid having an iodine value of 19.5 and an average chain length of the fatty acid moieties of 17.3 was placed with 0.2% by weight of 50% by weight hypophosphorous acid in an electrically heated reactor equipped with a thermometer, a mechanical stirrer and a rectifying column. 380 g (2.58 mol) of an amine mixture, containing 93% by weight bis-(2-hydroxypropyl)-methylamine and 7% by weight (2-hydroxypropyl)-(1-methyl-2-hydroxyethyl)-methylamine, was added with stirring. The resulting mixture was heated with stirring to 190° C. and was kept at this temperature for 4 h at ambient pressure, distilling off water through the rectifying column. The pressure was then reduced to 10 mbar and the mixture was further stirred at 190° C., water being removed with a vacuum pump until an acid value of the reaction mixture of 6.7 mg KOH/g was reached. The resulting mixture was then cooled to 70° C., 299.7 g (2.37 mol) of dimethyl sulphate was added and the resulting mixture was stirred for 2 h at 70 to 90° C.

The resulting fabric softener active composition was a viscous liquid at 90° C., having a total amine value of 4.8 mg KOH/g.

The mixture of example 1 comprises about 78-82% by weight of diester quat and about 18-22% by weight of other fabric softening actives being mostly MonoEsterQuat and diesteramines. The diester quat comprises, measured by $^{13}C$ NMR, about 13% of fabric softening active of formula A, 87% by weight of fabric softener of formula B.

Example 2: Preparation of Fabric Softener Actives Mixture 237 g (2.34 mol) triethylamine were added to a solution of 176.6 g (1.2 mol) bis-(2-hydroxypropyl)-methylamine in 2500 g dichloromethane. 690 g (2.34 mol) of fatty acid chloride, prepared from the fatty used in example 1, were added drop wise with stirring and cooling to keep the temperature in a range of 40 to 45° C. The mixture was stirred for a further 12 h at this temperature, cooled to ambient temperature and 4000 g dichloromethane were added. The resulting solution was washed several times with saturated aqueous NaCl solution, aqueous Ca(OH)2 solution and 50% by weight aqueous K2CO3 solution and dried with Na2SO4. Dichloromethane was distilled off to provide 628 g of an esteramine mixture having an acid value of 2.3 mg KOH/g.

108.5 g (0.86 mol) of dimethyl sulphate were added to the esteramine mixture at 65 to 90° C. and the resulting mixture was for 2 h at this temperature.

The resulting fabric softener active composition was a viscous liquid at 90° C., having a total amine value of 5.5 mg KOH/g.

The mixture of example 2 comprises about 78-82% by weight of diester quat and about 18-22% by weight of other fabric softening actives being mostly MonoEsterQuat and diesteramine. The diester quat comprises, measured by $^{13}C$ NMR, 100% of fabric softener of formula B.

Examples 3-26: Fabric Softener Compositions

The fabric softener compositions of examples 3-26 are prepared as described below.

Water, chelant, HCl formic acid, and CaCl are mixed together in a plastic beaker with a blade mixer. This waterseat is heated up in 1 liter plasic bottles in an oven at 65° C.

The fabric softener of example 1 or 2 is heated up in an oven at 85° C.

The waterseat is mixed with a rushton mixer in a baffled 2 liter tank at a temperature of about 63-64° C. The fabric softener directly coming from the oven is injected with a syringe into the hot water. The obtained dispersion is cooled down by air.

The additional ingredients are added to the dispersion at room temperature using a high shear mixer at 8000 RPM for 15 seconds.

| | (weight percent) | | | | | | | |
|---|---|---|---|---|---|---|---|---|
| Ingredient | 3i | 3c | 4i | 4c | 5i | 5c | 6i | 6c |
| fabric softener actives mixture of ex. 1 (invention) | 7.6 | | 7.6 | | 7.7 | | 7.6 | |
| fabric softener actives mixture of ex. 2 (comparative) | | 7.6 | | 7.6 | | 7.7 | | 7.6 |
| Formic acid | 0.043 | 0.043 | 0.043 | 0.043 | 0.044 | 0.044 | 0.043 | 0.043 |
| HCl | 0.01 | 0.01 | 0.01 | 0.01 | 0.01 | 0.01 | 0.01 | 0.01 |
| PDMS antifoam[1] | 0.1 | 0.1 | 0.1 | 0.1 | 0.1 | 0.1 | 0.1 | 0.1 |

-continued

| Ingredient | (weight percent) 3i | 3c | 4i | 4c | 5i | 5c | 6i | 6c |
|---|---|---|---|---|---|---|---|---|
| Formaldehyde scavenger[2] | | | 0.1 | 0.1 | | | 0.3 | 0.3 |
| $CaCl_2$ | 0.02 | 0.02 | 0.02 | 0.02 | 0.02 | 0.02 | 0.02 | 0.02 |
| NaHEDP Chelant | 0.007 | 0.007 | 0.007 | 0.007 | 0.007 | 0.007 | 0.007 | 0.007 |
| Thickener[3] | 0.1 | 0.1 | 0.1 | 0.1 | | | 0.03 | 0.03 |
| Dye | <0.1 | <0.1 | <0.1 | <0.1 | <0.1 | <0.1 | <0.1 | <0.1 |
| Perfume | 3.3 | 3.3 | 2 | 2 | 2.4 | 2.4 | 2 | 2 |
| PMC slurry A[5] | | | 1 | 1 | | | 1 | 1 |
| PMC slurry B[6] | | | 0.25 | 0.25 | | | 0.25 | 0.24 |
| Water (demineralized) | Bal. | Bal. | Bal. | Bal. | Bal. | Bal. | Bal. | Bal. |
| Viscosity[7] | 1304 | 449 | 1020 | 75 | 742 | 49 | 498 | 28 |

Compositions according to the invention (3i, 4i, 5i, 6i) have respectively a higher viscosity than composition 3c-6c.

| Ingredient | (weight percent) 7i | 7c | 8i | 8c | 9i | 9c | 10i | 10c |
|---|---|---|---|---|---|---|---|---|
| fabric softener actives mixture of ex. 1 (invention) | 5.1 | | 5.1 | | 5.2 | | 5.2 | |
| fabric softener actives mixture of ex. 2 (comparative) | | 5.0 | | 5.0 | | 5.1 | | 5.1 |
| Formic acid | 0.045 | 0.045 | 0.044 | 0.044 | 0.045 | 0.045 | 0.045 | 0.045 |
| HCl | 0.01 | 0.01 | 0.01 | 0.01 | 0.01 | 0.01 | 0.01 | 0.01 |
| PDMS antifoam[1] | 0.1 | 0.1 | 0.1 | 0.1 | 0.1 | 0.1 | 0.1 | 0.1 |
| Formaldehyde scavenger[2] | | | 0.3 | 0.3 | | | | |
| $CaCl_2$ | 0.02 | 0.02 | 0.02 | 0.02 | 0.02 | 0.02 | 0.02 | 0.02 |
| NaHEDP Chelant | 0.007 | 0.007 | 0.007 | 0.007 | 0.007 | 0.007 | 0.007 | 0.007 |
| Thickener[3] | 0.1 | 0.1 | 0.03 | 0.03 | 0.03 | 0.03 | 0.03 | 0.03 |
| Dye | <0.1 | <0.1 | <0.1 | <0.1 | <0.1 | <0.1 | <0.1 | <0.1 |
| Perfume | 3.3 | 3.3 | 2 | 2 | 2.4 | 2.4 | 2.2 | 2.2 |
| PMC slurry A[5] | | | 1 | 1 | | | | |
| PMC slurry B[6] | | | 0.25 | 0.25 | | | | |
| Water (demineralized) | Bal. | Bal. | Bal. | Bal. | Bal. | Bal. | Bal. | Bal. |
| Viscosity[7] | 190 | 67 | 91 | 11 | 49 | 14 | 44 | 13 |
| Phase split[8] | NO | YES | NO | YES | NO | YES | NO | YES |

Compositions according to the invention (7i, 8i, 9i, 10i) have respectively a higher viscosity and are more stable than composition 7c-10c.

Compositions according to the present invention include examples 11 to 26:

| Ingredient | (weight percent) 11 | 12 | 13 | 14 | 15 | 16 | 17 | 18 |
|---|---|---|---|---|---|---|---|---|
| fabric softener actives mixture of ex. 1 (invention) | 3.5 | 5 | 10 | 10 | 15 | 18 | 10 | 18 |
| Formic acid | 0.045 | 0.045 | 0.044 | 0.044 | 0.045 | 0.045 | 0.044 | 0.045 |
| HCl | 0.01 | 0.01 | 0.01 | 0.01 | 0.01 | 0.01 | 0.01 | 0.01 |
| PDMS antifoam[1] | 0.1 | 0.1 | 0.1 | 0.1 | 0.1 | 0.1 | 0.1 | 0.1 |
| Formaldehyde scavenger[2] | 0.3 | 0.3 | 0.3 | 0.3 | 0.3 | | 0.3 | |
| $CaCl_2$ | 0.02 | 0.02 | 0.02 | 0.02 | 0.02 | 0.02 | 0.02 | 0.02 |
| NaHEDP Chelant | 0.007 | 0.007 | 0.007 | 0.007 | 0.007 | 0.007 | 0.007 | 0.007 |
| Thickener[3] | 0.1 | 0.1 | 0.03 | 0.03 | 0.03 | 0.03 | 0.03 | 0.03 |
| Antibac[4] | | 0.5 | | | | | 0.5 | 0.5 |
| Dye | 0.05 | 0.003 | 0.03 | 0.005 | 0.01 | 0.05 | 0.003 | 0.03 |
| Perfume | 1.5 | 3 | 3 | 0.5 | 3.5 | 0.4 | 0.5 | 0.4 |
| PMC slurry A[5] | 0.5 | 0.5 | 0.5 | | 0.5 | | | |

-continued

| | | | | | | | | |
|---|---|---|---|---|---|---|---|---|
| PMC slurry B[6] | 0.5 | 0.5 | 0.5 | | | | | |
| Water (demineralized) | Bal. | Bal. | Bal. | Bal. | Bal. | Bal. | Bal. | Bal. |

| | (weight percent) | | | | | | | |
|---|---|---|---|---|---|---|---|---|
| Ingredient | 19 | 20 | 21 | 22 | 23 | 24 | 25 | 26 |
| fabric softener actives mixture of ex. 1 (invention) | 3.5 | 5 | 10 | 10 | 15 | 18 | 10 | 18 |
| Coconut-oil | | | 0.5 | | | 1 | | 2 |
| Behenic acid | 0.5 | 0.2 | | | | | | |
| Stearyl alcohol | | | | | 0.5 | | 0.2 | |
| Glycerol monostearate | | | | 1 | | | | |
| Formic acid | 0.045 | 0.045 | 0.044 | 0.044 | 0.045 | 0.045 | 0.044 | 0.045 |
| HCl | 0.01 | 0.01 | 0.01 | 0.01 | 0.01 | 0.01 | 0.01 | 0.01 |
| PDMS antifoam[1] | 0.1 | 0.1 | 0.1 | 0.1 | 0.1 | 0.1 | 0.1 | 0.1 |
| Formaldehyde scavenger[2] | 0.3 | 0.3 | 0.3 | 0.3 | 0.3 | | 0.3 | |
| $CaCl_2$ | 0.02 | 0.02 | 0.02 | 0.02 | 0.02 | 0.02 | 0.02 | 0.02 |
| NaHEDP Chelant | 0.007 | 0.007 | 0.007 | 0.007 | 0.007 | 0.007 | 0.007 | 0.007 |
| Thickener[3] | 0.1 | 0.1 | 0.03 | 0.03 | 0.03 | 0.03 | 0.03 | 0.03 |
| Antibac[4] | | 0.5 | | | | | 0.5 | 0.5 |
| Dye | 0.05 | 0.003 | 0.03 | 0.005 | 0.01 | 0.05 | 0.003 | 0.03 |
| Perfume | 1.5 | 3 | 3 | 0.5 | 3.5 | 0.4 | 0.5 | 0.4 |
| PMC slurry A[5] | 0.5 | 0.5 | 0.5 | | 0.5 | | | |
| PMC slurry B[6] | 0.5 | 0.5 | 0.5 | | | | | |
| Water (demineralized) | Bal. | Bal. | Bal. | Bal. | Bal. | Bal. | Bal. | Bal. |

[1]MP10 ®, supplied by Dow Corning, 8% activity
[2]Lupamin ® 1595, polyvinylamine (supplied by BASF, 10% activity
[3]Rheovis ® CDE, supplied by BASF
[4]Bardac ® 2250, supplied by Lonza, 50% activity
[5]as described in U.S. Pat. No. 8,765,659, 30.8% encapsulated oil
[6]as described in U.S. Pat. No. 8,765,659, 31.0% encapsulated oil
[7]Brookfield ® DV-E viscosity in cP, at 60 rpm, at room T ° C., 24 hours after making
[8]after 3 weeks at 20° C.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric enhancer composition comprising from about 0.1% to about 50% by weight of fabric softening active of formula (A):

$$\{[R^2]_2N^+[CH_2\text{-}CH(CH_3)\text{-}O\text{—}C(=O)\text{—}R^1][CH(CH_3)\text{-}CH_2\text{-}O\text{—}C(=O)\text{—}R^1]\}X^-$$

wherein each $R^2$ is independently either hydrogen, a short chain $C_1$-$C_6$ alkyl, $C_1$-$C_3$ hydroxyalkyl group, a poly ($C_{2\text{-}3}$ alkoxy), or benzyl, wherein each $R^1$ is independently a hydrocarbyl group or substituted hydrocarbyl group comprising about 11 to about 21 carbon atoms, and wherein $X^-$ is any fabric enhancer compatible anion, the composition comprising no more than about 50% by weight of diester quaternary ammonium compound.

2. A fabric enhancer composition according to claim 1, wherein each $R^2$ is independently methyl, ethyl, propyl, hydroxyethyl, hydroxyisopropyl, polyethoxy or polypropoxy, wherein each $R^1$ is a group comprising 13 to 19 carbon atoms, and wherein $X^-$ is chloride, bromide, methylsulfate, ethylsulfate, sulphate or nitrate.

3. A fabric enhancer composition according to claim 1, comprising from about 0.2% to 30%, by weight of fabric softening active of formula (A).

4. A fabric enhancer composition according to claim 1, further comprising fabric softening active of formula (B):

$$\{[R^2]_2N^+[CH_2\text{—}CH(CH_3)\text{—}O\text{—}C(=O)\text{—}R^1]_2\}X^-$$

wherein each $R^2$ is independently either hydrogen, a short chain $C_1$-$C_6$ alkyl, $C_1$-$C_3$ hydroxyalkyl group, a poly ($C_{2\text{-}3}$ alkoxy), benzyl, or mixtures thereof, wherein each $R^1$ is independently a hydrocarbyl group or substituted hydrocarbyl group comprising about 11 to about 21 carbon atoms, and wherein $X^-$ is any fabric enhancer compatible anion.

5. A fabric enhancer composition according to claim 4, wherein the weight ratio of [fabric softening active of formula A] to [total amount of fabric softening active of formula A and of formula B] is from about 0.01 to about 0.99.

6. A fabric enhancer composition according to claim 1, wherein the weight ratio of [fabric softening active of formula A] to [total amount of fabric softening active] is from about 0.01 to about 0.99.

7. A fabric enhancer composition according to claim 1, wherein the composition is liquid and has a pH at about 20° C. between about 2 and about 5.

8. A fabric enhancer composition according to claim 1, further comprising an additional fabric softening active comprising fatty acid, softening oil or mixtures thereof, wherein the fabric enhancer composition comprises from about 1% to about 50%, by weight of total fabric softening actives.

9. A fabric enhancer composition according to claim 1, wherein the additional fabric softening active is selected from coconut-oil, palmityl acid, behenic acid, stearyl alcohol, glycerol monostearate, or mixtures thereof.

10. A fabric enhancer composition according to claim 1, comprising from about 0.1% to about 5%, by weight of additional fabric softening active.

11. A fabric enhancer according to claim 2 wherein each $R^2$ is a methyl, each $R^1$ is a group comprising 15 to 17 carbon atoms, and $X^-$ is chloride or methylsulfate.

* * * * *